US010316608B2

(12) United States Patent
Rao et al.

(10) Patent No.: US 10,316,608 B2
(45) Date of Patent: Jun. 11, 2019

(54) COMPACT CUTTING SYSTEM AND METHOD

(71) Applicant: Worldwide Oilfield Machine, Inc., Houston, TX (US)

(72) Inventors: Reddi Udaya Bhaskara Rao, Singapore (SG); Tom McCreadie, Houston, TX (US)

( * ) Notice: Subject to any disclaimer, the term of this patent is extended or adjusted under 35 U.S.C. 154(b) by 35 days.

(21) Appl. No.: 15/647,490

(22) Filed: Jul. 12, 2017

(65) Prior Publication Data

US 2017/0328165 A1 Nov. 16, 2017

Related U.S. Application Data

(63) Continuation of application No. 14/518,404, filed on Oct. 20, 2014, now Pat. No. 9,732,576.

(51) Int. Cl.
*E21B 33/06* (2006.01)

(52) U.S. Cl.
CPC ..... *E21B 33/063* (2013.01)

(58) Field of Classification Search
CPC ..... E21B 33/063; E21B 33/06–33/064; E21B 29/08; E21B 29/00; Y10T 83/9447; Y10T 83/0581; Y10T 83/0596
USPC ..... 166/55, 85.4, 297, 298, 361, 364, 379, 166/387, 363
See application file for complete search history.

(56) References Cited

U.S. PATENT DOCUMENTS

| | | | |
|---|---|---|---|
| 3,561,526 A | 2/1971 | Williams, Jr. et al. | |
| 4,081,027 A | 3/1978 | Nguyen | |
| 5,515,916 A | 5/1996 | Haley | |
| 6,173,770 B1 | 1/2001 | Morrill | |
| 6,357,529 B1 | 3/2002 | Kent et al. | |
| 6,601,650 B2 | 8/2003 | Sundararajan | |
| 8,353,338 B2 | 1/2013 | Edwards | |
| 8,740,174 B2 | 6/2014 | Juda et al. | |
| 8,800,954 B2 | 8/2014 | Edwards | |
| 9,732,576 B2 | 8/2017 | Rao | |
| 2003/0029619 A1 | 2/2003 | Sundararajan | |
| 2006/0113501 A1 * | 6/2006 | Isaacks | E21B 33/063 251/1.1 |

(Continued)

FOREIGN PATENT DOCUMENTS

| | | |
|---|---|---|
| WO | 2006/048669 | 5/2006 |
| WO | 2007/122365 | 11/2007 |

(Continued)

OTHER PUBLICATIONS

International Search Report dated Feb. 11, 2016 for PCT/US2015/054429 filed Oct. 7, 2015.

(Continued)

*Primary Examiner* — George S Gray
(74) *Attorney, Agent, or Firm* — Kenneth L. Nash; Thomas D. Nash

(57) ABSTRACT

As compared to a BOP, a compact lightweight cutting system may have two gates with cutters moveable in opposite directions to cut drill pipe. The system utilizes a relatively short stroke and relatively less hydraulic oil for subsea operation. The system utilizes two gates with flat surfaces for sealing with the two corresponding upper and lower seats. The compact cutting system with a gate valve can be used to substitute for a BOP to significantly reduce the size and weight required in an intervention system.

21 Claims, 6 Drawing Sheets

(56) References Cited

U.S. PATENT DOCUMENTS

| | | | | |
|---|---|---|---|---|
| 2010/0218955 | A1* | 9/2010 | Hart | E21B 33/035 166/377 |
| 2014/0034316 | A1 | 2/2014 | Larson | |
| 2016/0102518 | A1* | 4/2016 | Araujo | A47G 19/2266 251/1.3 |
| 2016/0138356 | A1* | 5/2016 | Ellison | E21B 33/063 166/377 |

FOREIGN PATENT DOCUMENTS

| | | |
|---|---|---|
| WO | 2012/000098 | 1/2012 |
| WO | 2014/144792 | 9/2014 |

OTHER PUBLICATIONS

Extended European Search Report, dated Apr. 24, 2018, for PCT/US2015054429.

* cited by examiner

COMPACT CUTTING SYSTEM AND METHOD

BACKGROUND OF THE INVENTION

Field of the Invention

The present invention relates generally to cutting devices or systems and, more particularly, to a cutting device or system operable for repeatedly cutting drill pipe, tubing, coiled tubing, and/or wireline so as to be especially suitable for use in a lightweight intervention package and/or in substitutions for replacing at least one BOP in an intervention package.

Background of the Invention

Blowout Preventer (B.O.P.) stacks are frequently utilized in oilfield wellbore Christmas trees and subsea intervention operations such as, for instance, lower riser packages in offshore wells. B.O.P. stacks may include a first set of rams for sealing off the wellbore and a second set of rams for cutting pipe such as tubing, wireline and/or intervention tools. However, B.O.P. stacks are quite bulky and heavy, which are undesirable features especially in lower riser packages for undersea operation where space is often at a premium. B.O.P. stacks tend to be expensive for installation and removal due to the need for heavy lifting equipment. Moreover, if maintenance is required, then the high maintenance costs for utilizing B.O.P. stacks for intervention purposes severely limits the wells that can be economically reworked. B.O.P. stacks may frequently require maintenance after cutting pipe. For instance, the cut pipe may become stuck within the B.O.P. stack blocking other operations.

Consequently, those skilled in the art will appreciate the present invention that addresses the above problems.

The following patents discuss background art related to the above discussed subject matter:

U.S. Pat. No. 6,601,650, issued Aug. 5, 2003, to A. Sundararajan, which is incorporated herein by reference, discloses apparatus and methods for replacing a BOP with a gate valve to thereby save space, initial costs, and maintenance costs that is especially beneficial for use in offshore subsea riser packages. The method provides a gate valve capable of reliably cutting tubing utilizing a cutting edge with an inclined surface that wedges the cut portion of the tubing out of the gate valve body. A method and apparatus is provided for determining the actuator force needed to cut the particular size tubing.

U.S. Pat. No. 8,353,338, issued Jan. 15, 2013, to J. Edwards, discloses a well bore control valve comprising a housing defining a throughbore, the throughbore adapted to receive a first tubular. The valve further comprises first and second gates located within the housing, the gates being movable in different directions transverse to the throughbore between the throughbore open position and the throughbore closed position. Movement of the gates from the throughbore open position to the throughbore closed position, in use, shares a tubular located between the gates. The valve also comprises a first seal seat performing a seal of one of the gates in the throughbore closed position to seal the throughbore.

U.S. Patent Application No. 20100218955 discloses an oil field system comprising a main body having a bore therethrough, the main body having a connection at one end of the bore for, in use, connecting the main body to an existing wellhead, tree or other oil field equipment, a transverse cavity through the bore, the cavity having at least one opening to the outside of the main body, a plurality of flow control systems for insertion, at different times, into the cavity in order to selectively control fluid flow through the bore, wherein the plurality of flow control systems includes a gate valve and drilling BOP rams.

The above prior art does not disclose the cutting system operable for cutting drill pipe while still being very lightweight as described in the present specification. Consequently, those skilled in the art will appreciate the present invention that addresses the above and/or other problems.

SUMMARY OF THE INVENTION

An object of the present invention is to provide an improved cutting apparatus and/or system.

Another possible object of the present invention is to provide a non-sealing compact cutting device to cut drill pipe at least up to 3½ inches and allows use with a gate valve for sealing the wellbore with the combination to substitute for a much heavier BOP.

Yet another possible object of the present invention is to provide a compact cutting system with a short stroke length and/or piston rod assemblies and/or lesser fluid volumes at different vertical heights.

Accordingly, a compact cutting system is provided that is operable for cutting 4½ inch 16.60 lb/ft drill pipe, coiled tubing, wireline and sinker bar. The cutting system comprises a housing defining a throughbore, a first gate and a second gate mounted within the housing. The first gate and the second gate are moveable transversely with respect to the throughbore between an open position and a closed position. In one embodiment, the first and second gates comprise openings therein that prevent sealing of the throughbore in the closed position.

The compact cutting system may further comprise a gate valve wherein the compact cutting system is operable for substitution of at least one BOP.

In one possible embodiment, the system may comprise a first piston and a first piston rod operably connected to the first gate with a first stroke length. A second piston and a second piston rod is operably connected to the second gate with a second stroke length. The first and second stroke lengths are less than a diameter of the throughbore.

In one possible embodiment, the first gate and the second gate each comprise a gate bore therethrough, in the open position each gate bore is in surrounding relationship to or form a portion the throughbore. In one embodiment, the gate bore is elliptical.

In one possible embodiment, when the throughbore is oriented vertically then the first piston and first piston rod is mounted to the housing at a higher vertical position than the second piston and second piston rod.

In one embodiment, the first piston and the second piston each comprise a piston surface with a diameter between one and one-half and two and one-half times as large as a diameter of the throughbore.

The compact cutting system may further comprise a first piston chamber for the first piston and a second piston chamber for the second piston. The first piston and the second piston are mounted so that all of each piston surface is available for engagement with hydraulic fluid for use in closing the gates. The piston rod end of the piston may then be utilized for opening the gates.

In one possible embodiment, the cutting system may comprise a first seat mounted in the throughbore adjacent the first gate. The first seat has a first seat interior. The first seat interior decreases in diameter with distance away from the first gate. A second seat is mounted in the throughbore adjacent the second gate. In a similar manner, the second seat interior decreases in diameter with distance away from the second gate. In one embodiment, the interior of the seats may be elliptical.

In one possible embodiment, the compact cutting system may comprise a first seat mounted in the throughbore adjacent the first gate, a second seat mounted in the throughbore adjacent the second gate. The first gate and the second gate may comprise a passageway therethrough to prevent sealing between the first gate and the first seat and between the second gate and the second seat.

In one possible embodiment, the first piston rod and the second piston rod comprise a length less than two and one-quarter times as large as a diameter of the throughbore. The first piston and the second piston each comprise a piston surface with a diameter between one and one-half and two and one-half times as large as a diameter of the throughbore.

These and other objects, features, and advantages of the present invention will become clear from the figures and description given hereinafter. It is understood that the objects listed above are not all inclusive and are only intended to aid in more quickly understanding the present invention, not to limit the bounds of the present invention in any way.

BRIEF DESCRIPTION OF THE DRAWINGS

The above general description and the following detailed description are merely illustrative of the generic invention, and additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Abbreviations include the following:

API—American Petroleum Institute

DNV—Det Norske Veritas (The Norwegian Veritas)

ISO—International Standardization Organization

ROV—remotely operated vehicle

NACE—National Association of Corrosion Engineers

QTC—Qualification Test Coupon

The use of CCD 10 complies with codes and standards including:

API 6A, Specification for wellhead and Christmas tree equipment, 20th Edition, October 2010;

API 16A, Specification for Drill-through equipment, 3rd Edition, June 2004;

API 16D Control Systems for Drilling Well control Equipment, 2nd Edition, July 2004;

NORSOK D-002, Well intervention equipment, Revision 2, June 2013;

DNV-OS-E101, Drilling Plant, October 2013;

ISO 13533, Drilling and production equipment—Drill-through equipment, 1st Edition, December 2001;

API 17G, Recommended practice for completion/workover risers, $2^{nd}$ Edition, July 2006

NACE MR0175/ISO 15156, Petroleum and natural gas industries—materials for use in H2S-containing environments in oil and gas production, 2nd Edition, October 2009.

Figure 1:
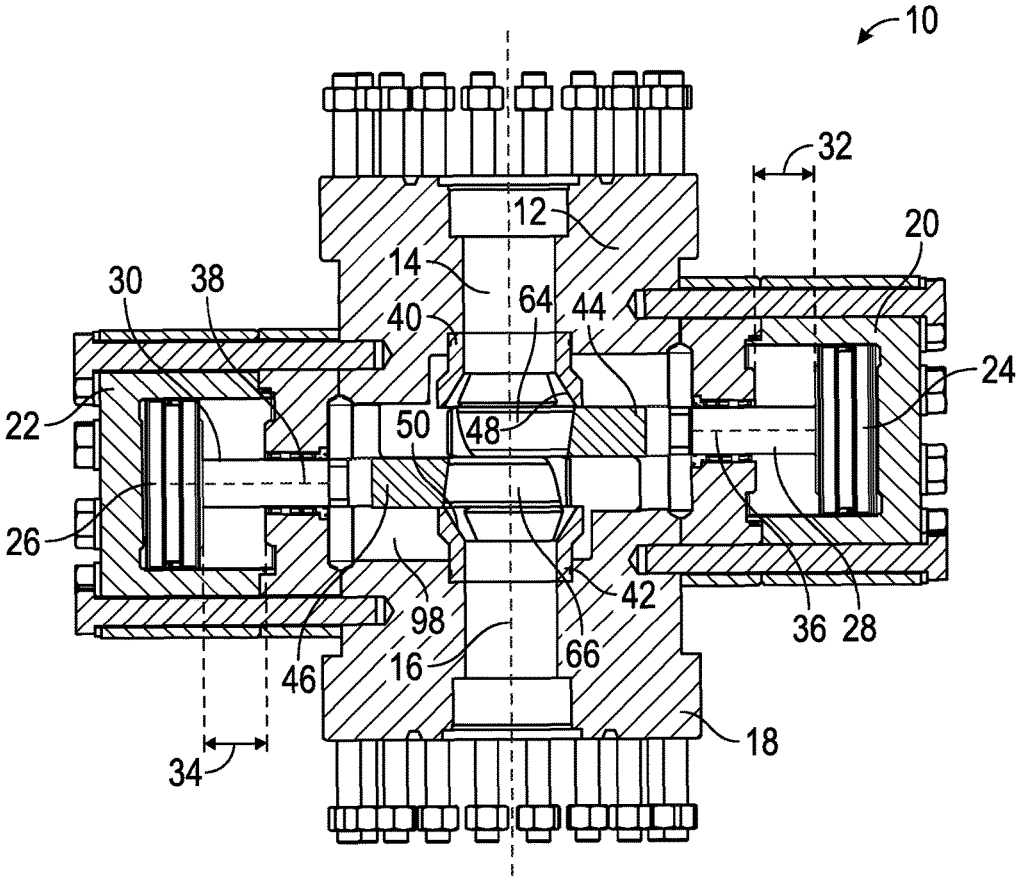
FIG. 1 is a front elevational view, in section, of a compact cutting system in the open position in accord with one possible embodiment of the present invention.

Referring now to the drawings and more particularly to FIG. 1, there is shown one possible embodiment of a compact cutting device or system which may be referred to herein as CCD 10. Housing 12 defines throughbore 14 with axis 16. Flange connection 18 at the bottom end, which may comprise studs or the like, may be utilized for connection with well equipment such as subsea installations, well intervention equipment, and the like. Another flange connection at the top end may connect to other well equipment such as a gate valve or the like. One embodiment of CCD 10 comprises a 7⅜ inch throughbore, with a 10K psi pressure rating. The top and bottom connectors may comprise a 13⅝ inch 10K psi studded connectors and/or flange connections. In one embodiment, CCD 10 is operable to cut pipe 68 (see FIG. 9) which may comprise 3½ in 13.3 lb/ft Grade E 75 drill pipe (Table 18, API 16A/ISO 13533) without leaving any snag or slug after cutting. In one embodiment, CCD 10 operates very quickly and can cut the drill string in less than 2 seconds when using an accumulator. The tests to be conducted for CCD 10 for use in an intervention package include NORSOK D-002 (API 16A/ISO 13533 Annex C) in one possible embodiment for cutting only, without the need for sealing tests as explained hereinafter. Further in one embodiment, CCD 10 weighs less than 12,000 pounds. Combined with a gate valve, the combination is much less than the weight of a BOP, which provides an opportunity for a highly desirable substitution in an intervention package.

The light weight makes possible reworking of wells much less expensive than using a BOP.

Figure 2:
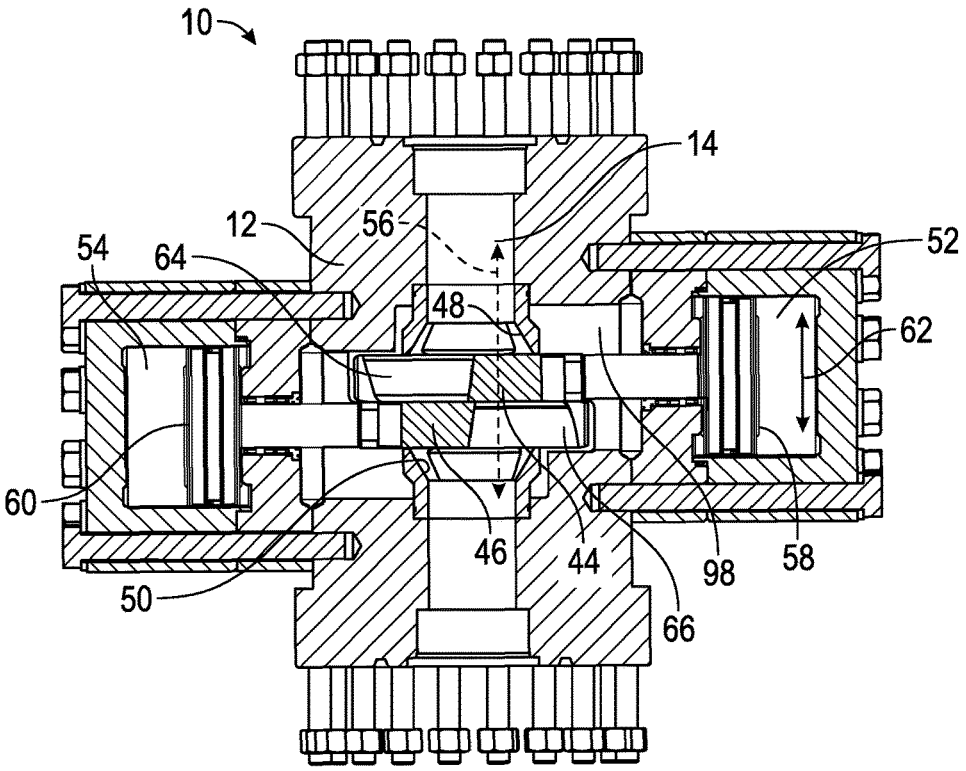
FIG. 2 is a front elevational view, in section, of a compact cutting system in the closed position in accord with one possible embodiment of the present invention.
Figure 3:
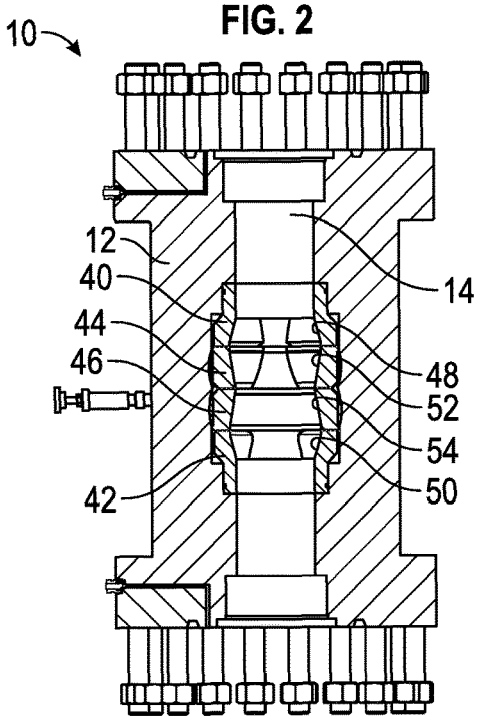
FIG. 3 is a side elevational view, in section, of a compact cutting system in accord with one possible embodiment of the present invention.
Figure 9:
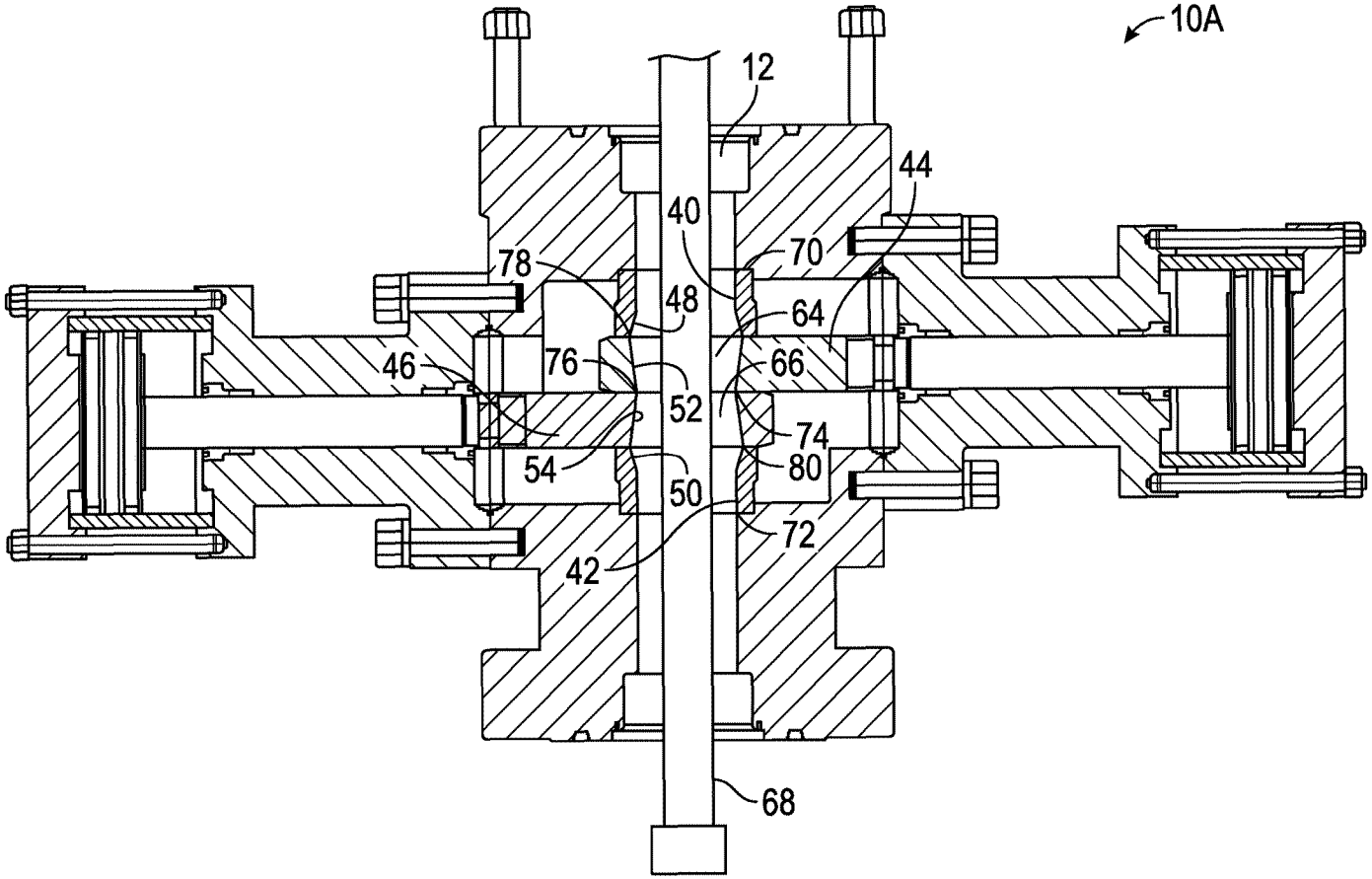
FIG. 9 is an elevational view of a cutter in accord with one possible embodiment of the present invention.

Cylinder housings 20 and 22 are utilized to house pistons 24 and 26, respectively, which drive piston rods 28 and 30 to move gates 44 and 46 between an open position and a closed position. FIG. 1, FIG. 3, and FIG. 9 show gates in an open or open throughbore position. FIG. 2 shows the gates in a closed position. As discussed below, in one possible embodiment moving the gates to the closed position does not necessarily provide a seal but instead in one presently preferred embodiment fluid flow may occur past the gates. However, if desired, the gates could also be made to provide a seal when closed.

In one embodiment, stroke length 32 and 34 of the pistons is relatively short so as to be less than the diameter of throughbore 14. In one embodiment of a 7⅜ inch throughbore, the stroke length may be in the range of 5 inches. However, larger and smaller stroke lengths could be utilized. In one embodiment, compact cutting system CCD 10 advantageously utilizes considerably less volume of hydraulic fluid to operate in comparison to other units with cutting capability, e.g. a BOP. In one embodiment, the present invention utilizes less than 12 liters of hydraulic fluid for opening or closing the gates.

It will be noted that when CCD 10 is vertically oriented that piston 24, rod 28, gate 44, and the axis of movement 36 of rod 28 is vertically higher than piston 26, rod 30, gate 46 and axis 38 of rod 30. Likewise, piston housing 20 with associated bolts is vertically higher than piston housing 22 as shown in FIG. 1, FIG. 2, FIG. 5, and FIG. 9. The applied force is therefore directed along axis 36 and 38 of the pistons, piston rods and gates, which reduces bending forces acting on the piston rods 28 and 30 due to cutting forces applied by the gates, which are at different vertical heights.

In FIG. 2, valve cavity 98 can be irregularly shaped due to the different vertical heights of the components. In one embodiment, the diameter of the opening into housing 12 for the components used with each cylinder is almost the same diameter of the pistons and may be used for inserting the seats, gates, and other components.

Figure 4:
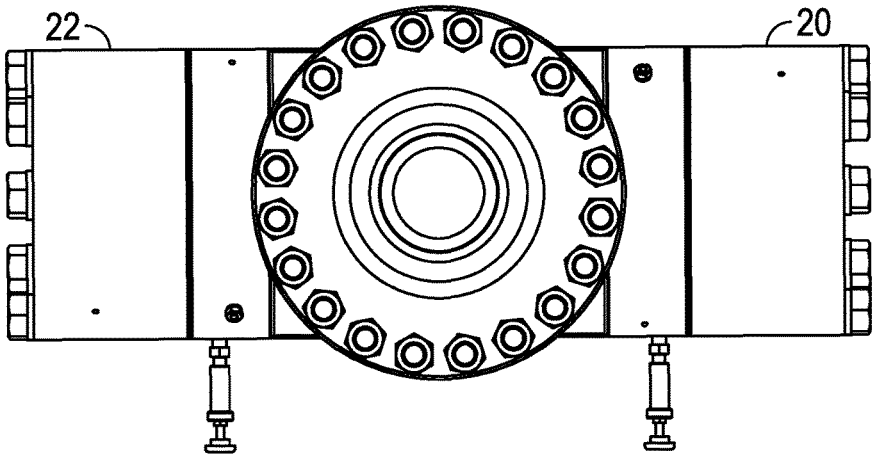
FIG. 4 is a top elevational view of a compact cutting system in accord with one possible embodiment of the present invention.
Figure 5:
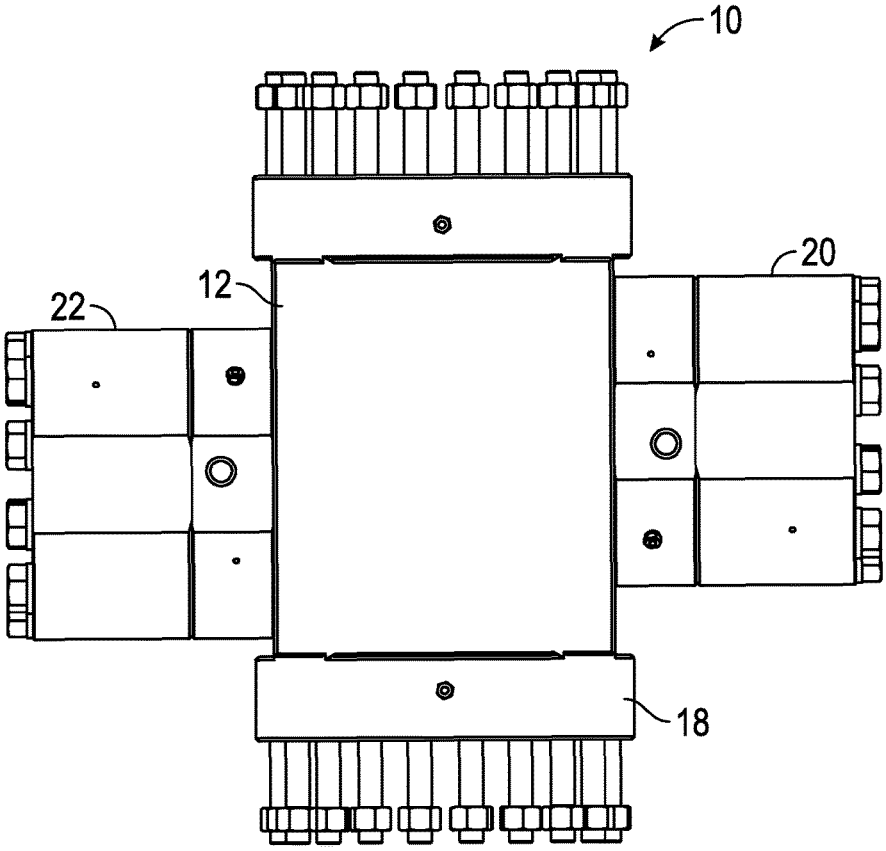
FIG. 5 is a front elevational view of a compact cutting system in accord with one possible embodiment of the present invention.

FIG. 4 shows the top elevational view whereby it can be seen that from an external view, cylinders 20 and 22 are aligned in top view, which may be considered the x-y plane. Accordingly, their associated pistons, piston rods, gates, piston axes are also aligned from this view. This is in contrast to FIG. 5, which shows that cylinder 20 is vertically higher than cylinder 22, which might be considered along a z-axis.

Figure 7A:
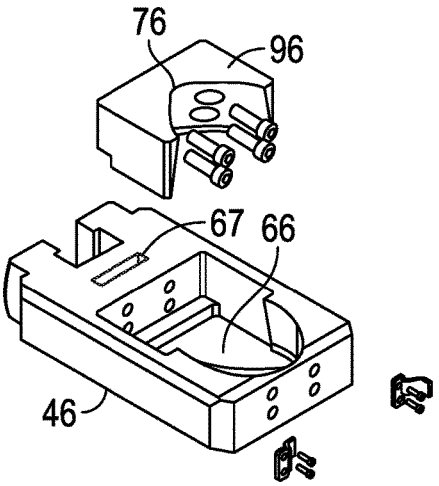
FIG. 7A is an enlarged view of a gate in accord with one possible embodiment of the present invention.
Figure 7B:
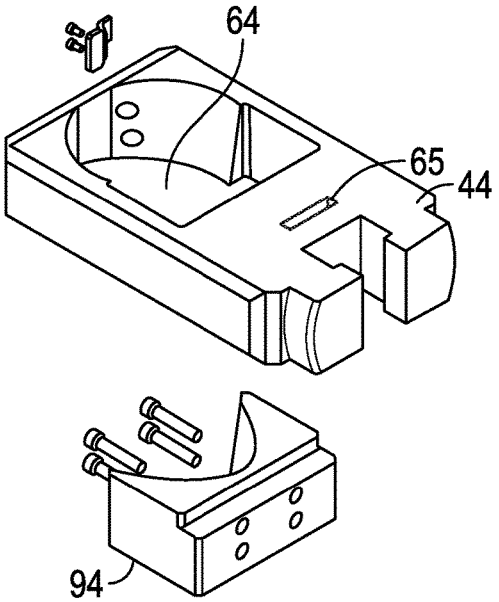
FIG. 7B is an enlarged view of a gate oriented in a reversed position with respect to FIG. 7A in accord with one possible embodiment of the present invention.

Referring again to FIG. 1, upper seat 40 and lower seat 42 are mounted in throughbore 14 in respective recesses in housing 12. Seats 40 and 42 may or may not seal with gates 44 and 46 when in the closed or closed throughbore position. In one embodiment, referring to FIG. 2 that shows CCD 10 in the closed position, openings are formed in gates 44 and 46 that positively prevent sealing when in the closed position as indicated by flowpath 56 through the gates 44 and 46, which allows for fluid flow even in the closed or closed throughbore position. For example, slots may be milled into gates 44 and 46 as shown in FIG. 7A and FIG. 7B at 65 and 67. In another embodiment additional openings, passageways, or the like may be formed with in the gates.

In another embodiment, if desired, and which is not necessarily a preferred embodiment, one or both gates could be made to seal with seats 40 and 42, with a metal to metal seal.

FIG. 2 also shows hydraulic fluid volumes 52 and 54 that are filled with pressurized hydraulic fluid to move the gates to the closed position. It will be appreciated that the entirety of piston surfaces 58 and 60 can be utilized to create force to drive the cutters in the gates to cut drill pipe or the like within throughbore 14. In one embodiment, diameter 62 of piston surfaces 58 and 60 may be in the range of 1½ to 2½ times the diameter of throughbore 14. In another embodiment the diameter may be between 1½ to 2 times the diameter of throughbore 14. In this way, a significant cutting force relative to pipe within throughbore 14 is produced, which allows the high speed powerful cutting. Use of surfaces 58 and 60 to create the force to drive the cutters takes advantage of the full surface of the pistons rather than using the side of the piston to which the piston rod is attached. Use of the piston rod side to drive the cutters would reduce the area on which the pressurized hydraulic fluid operates. Significant gate opening force is also available to open the gates by applying hydraulic fluid to the interior side of pistons 24 and 26. The piston rods connected to the interior size limit the force to some extent and in this embodiment may result in interior piston surfaces in the range of 132 square inches. Accordingly somewhat less hydraulic fluid is required for opening.

In one embodiment, the use of a shorter piston rod also helps produce a compact size for CCD 10. In one embodiment, piston rods 28 and 30 comprise a length less than 2¼ times the throughbore diameter and in another embodiment less than 2 times the throughbore diameter when measured from the inner surface of the piston to the end thereof.

As noted above, the cutting action is performed by moving the gates towards the wellbore so the full hydraulic piston surface area is used (not the rod end). This allows maximization of the performance and utilization of the hydraulic pressure available.

Using two gates 44, 46 causes the tool string to be centralized during the cut action rather than it being pushed to one side. The tool string is captured inside the two gate bores 64, 66 to provide crushing action to yield and cut the string in an area away from the upper and lower seats 40, 42. Gate bores 64, 66, comprise a minimum diameter of the throughbore, which in one embodiment is 7⅜ inches.

In one embodiment, the gate bores 64, 66 may be oval so that the minimum of 7⅜ is along one axis of the oval with the other axis of the oval being greater than the borehole diameter. Likewise, upper and lower seat 40, 42 may comprise an oval interior to match that of the gates.

Figure 6:
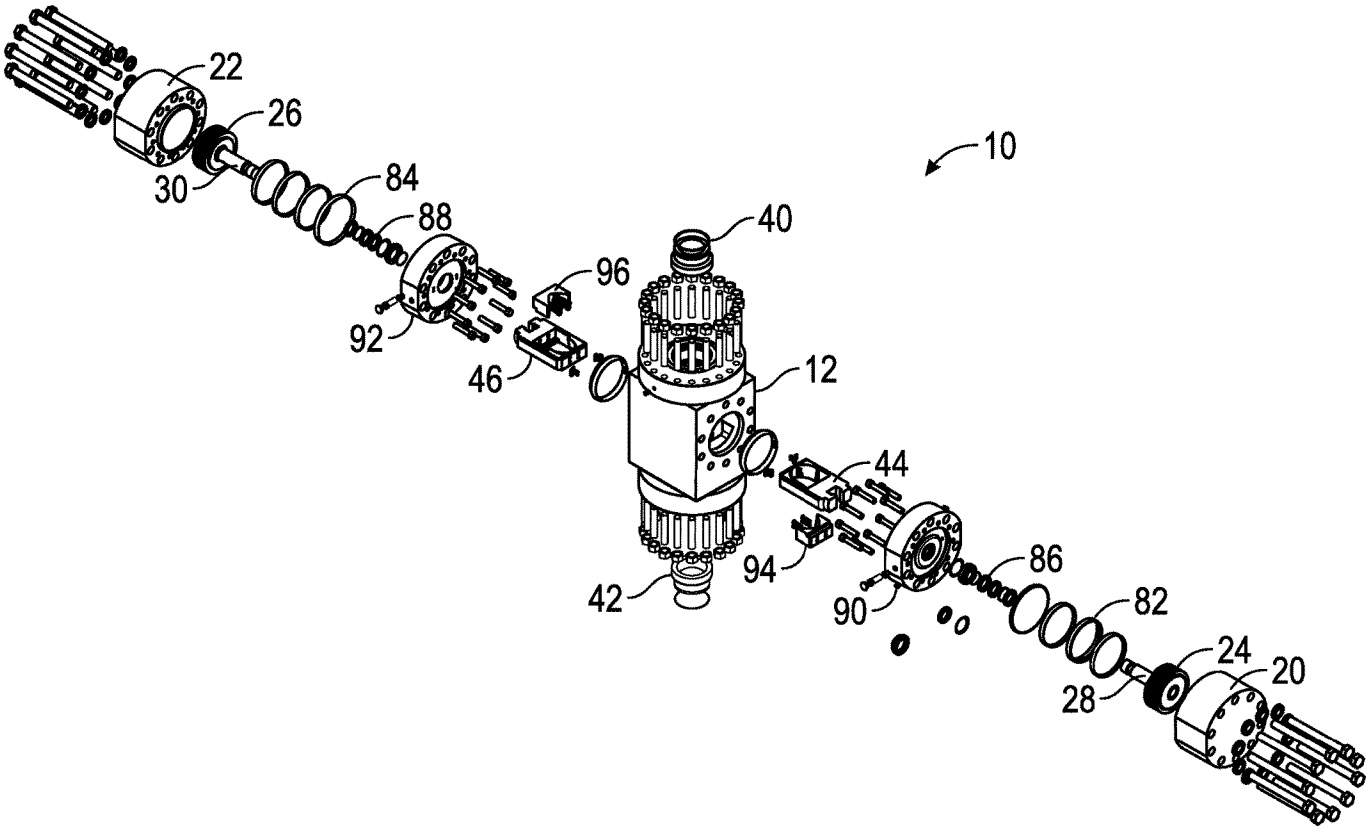
FIG. 6 is an exploded view of a compact cutting system in accord with one possible embodiment of the present invention.

FIG. 6 shows an exploded view of CCD 10, including piston seals 82, 84, piston rod seals 86, 88 and cylinder housing bases 90, 92. Other components have already been discussed but are shown here in a perspective view. It will be noted that external shapes of upper seat 40 and lower seat 42 as well as that of other components is shown.

FIG. 7A and FIG. 7B show enlarged views of gates 44 and 46 as well as cutter inserts 94 and 96. Gates 44 and 46 may or may not utilize cutter inserts such as cutter inserts 94 and 96. Utilizing cutter inserts 94, 96 allows the cutting surfaces to be changed out. Cutting face or surface 76 is shown in FIG. 7A. As discussed hereinbefore, gate openings or bores 64 and 66 preferably encircle throughbore 14 and drill pipe or the like within the throughbore when in the open position. In one embodiment openings or bores 64 and 66, with the corresponding cutter inserts 94, 96 are preferably circular or as shown in this embodiment, are oval. Openings 65, 67 and/or other openings can be milled into the gates and utilized to provide that the gates do not seal with the seats and allow fluid flow through the throughbore in the closed position as discussed hereinbefore. However, if desired, the openings may not be used and the gates could seal with the seats, although that is not the presently preferred embodiment. It will be noted that a T-slot connection can be used on the ends of the gate with corresponding T connector on the piston rods if desire.

In one embodiment, the taper angle at the cutting edge of the gates is unique. Cutting inserts may or may not be used. If desired, hard facing or case hardening process may not be used on the gates.

Figure 8:
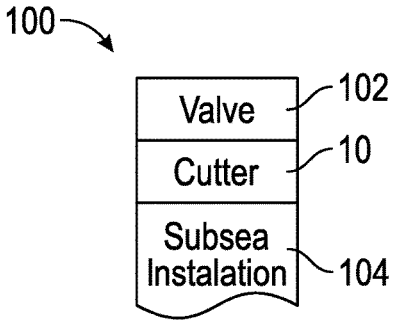
FIG. 8 is a schematic view of a compact cutter and gate valve that may be utilized in a subsea installation is place of at least one BOP (blowout preventer) in accord with one possible embodiment of the present invention.

FIG. 8 shows a schematic of intervention package 100 that comprises CCD 10, which may be utilized with gate valve 102 in conjunction with subsea installation 104 in substitutions for a much heavier BOP in accord with one embodiment of the invention. CCD 10 may be utilized to cut 3½ in. 13.3 lb/ft Grade E-75 drill pipe without leaving any snag after cutting in accord with Table 18, API 16A/ISO 13533 and may be utilized to cut up to 4½ IN 16.60 lb/ft drill pipe. The use of CCD 10 in place of the much heavier BOP for use in an intervention package complies with codes and standards including:

API 6A, Specification for wellhead and Christmas tree equipment, 20th Edition, October 2010;

API 16A, Specification for Drill-through equipment, 3rd Edition, June 2004;

API 16D Control Systems for Drilling Well control Equipment, 2nd Edition, July 2004;

NORSOK D-002, Well intervention equipment, Revision 2, June 2013;

DNV-OS-E101, Drilling Plant, October 2013;

ISO 13533, Drilling and production equipment—Drill-through equipment, 1st Edition, December 2001;

API 17G, Recommended practice for completion/workover risers, 2nd edition, July 2006

NACE MR0175/ISO 15156, Petroleum and natural gas industries—materials for use in H2S-containing environments in oil and gas production, 2nd Edition, October 2009.

FIG. 9, which is another embodiment of a cutting system, namely cutting system 10A, shows openings 64 and 66 in gates 44, 46 which surround throughbore 12 and pipe 68. Cutting system 10A utilizes longer cylinder rods and housing.

It will also be seen that gate opening 64 decreases in inner diameter with distance away from seat 40 as indicated by interior surface profile 52 until coming to cutting face 74 at the bottom of upper gate 44. Likewise, the inner diameter of gate opening 66 decreases with distance away from seat 42 as indicated by interior surface profile 55 until coming to a cutting face 76 at the top of lower gate 46. The changes in inner diameter of the openings 64, 66 through the gate can also be seen in FIG. 1, FIG. 2, and FIG. 3.

In this embodiment, the interior or inner diameter of upper seat 40 decreases in diameter with distance away from gate 44 as indicated by interior surface profile 48. The interior of lower seat 42 also decreases in diameter with distance away from lower gate 46 as indicated by interior surface profile 50. The decrease in diameter of the upper and lower seats discussed above leads to the throughbore diameter at about the midpoint of the seats, which in one embodiment may be 7⅜ inches. In other words, both the seats and the gates comprise openings which are larger than the throughbore diameter in some regions and then either approach or are at the throughbore diameter, e.g. at the cutting faces and at the upper portion of upper seat 40 and the lower portion of lower seat 42. The minimum diameter is the throughbore diameter. As discussed above, both the interior of the seats and the gates may be oval.

Upper seat seal surface 70 is recessed into housing 12 and seals with upper seat 40. Lower seat seal surface 72 is recessed into housing 12 and seals with lower seat 42. Face 78 is provided between first gate 44 and seat 40. Face 80 is provided between second gate 46 and seat 42. As discussed hereinbefore, in one embodiment the seats do not seal off throughbore 12 even when the gates are in the closed position. However, if desired, a metal to metal seal could be provided at face 78, 80 to seal off throughbore 12 with the gates in the closed position.

In one embodiment, CCD 10 is operable to cut pipe 68 which may comprise 3½ in 13.3 lb/ft Grade E 75 drill pipe (Table 18, API 16A/ISO 13533) or 4½ IN 16.60 lb/ft drill pipe.

In summary, the present invention provides a compact cutting system or device. In one embodiment to provide a 7⅜ throughbore, the compact cutting system or device may be in the range of 40 to 50 inches in height, in the range of 65 to 75 inches at maximum width, and with a diameter in the range of 20-25 inches, with a weight in the range of 11,000 to 12,000 pounds. In one embodiment, a relatively short stroke is utilized. In one embodiment, the piston rods are at different vertical heights. The openings in the gates preferably surround the throughbore or form part of the throughbore in the open position. In the closed position, the gates may be modified to provide that they do not seal with the seats.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

The invention claimed is:

1. A subsea cutting system operable for cutting a tubular, coiled tubing, and wireline, comprising:

a housing defining a throughbore;

a first gate and a second gate mounted within said housing, said first gate and said second gate being moveable transversely with respect to said throughbore between an open position and a closed position, said first and second gates being moveable in different directions with respect to each other;

a first piston and a first piston rod operably connected to said first gate with a first stroke length, a second piston and a second piston rod operably connected to said second gate with a second stroke length, said first and second stroke length being less than a diameter of said throughbore;

said first gate and said second gate being in slidable engagement with each other in said open position and in said closed position; and said first piston and said second piston being mounted to receive hydraulic fluid over an outermost side of said first piston and said second piston with respect to said throughbore whereupon said first gate and said second gate are moveable from said open position toward said closed position for cutting said tubular in response to receiving said hydraulic fluid.

2. The subsea cutting system of claim 1, further comprising a first gate flat surface that comprises a first flat surface portion positioned to engage with a first seat in said open position and a second flat surface portion positioned to engage with said first seat in said closed position, and a second gate flat surface comprises a first flat surface portion positioned to engage with a second seat in said open position and a second flat surface portion positioned to engage said second seat in said closed position.

3. The subsea cutting system of claim 2, said first seat comprising a first seat interior, said first seat interior comprising a decreasing internal diameter with distance away from said first gate, said second seat comprising a second seat interior, said second seat interior comprising a decreasing internal diameter with distance away from said second gate.

4. The subsea cutting system of claim 1, further comprising a first gate flat surface that comprises a first flat surface portion positioned to engage a first seat in said open position and a second flat surface portion positioned to engage said first seat in said closed position, and a second gate flat surface comprises a first flat surface portion positioned to engage with a second seat in said open position and a second flat surface portion positioned to engage said second seat in said closed position.

5. The compact subsea cutting system of claim 1, wherein said subsea cutting system weighs less than 12,000 pounds.

6. The subsea cutting system of claim 1, wherein said first piston and said second piston each comprise a piston surface with a diameter between one and one-half and two and one-half times as large as a diameter of said throughbore.

7. The subsea cutting system of claim 6, further comprising a first piston chamber for said first piston and a second piston chamber for said second piston, said first piston and said second piston being mounted so that all of each piston surface is available for engagement with hydraulic fluid when said first and second gates are moved to said closed position.

8. The subsea cutting system of claim 1, further comprising a first seat mounted in said throughbore adjacent said first gate, a second seat mounted in said throughbore adjacent said second gate, said first gate and said second gate comprising at least one passageway therethrough to prevent sealing between said first gate and said first seat, and between said second gate and said second seat when said first gate and said second gate are in the closed position.

9. The subsea cutting system of claim 1, wherein said first piston rod and said second piston rod comprise a length less than two times as large as a diameter of said throughbore.

10. The subsea cutting system of claim 1, comprising said first piston and said second piston being mounted to receive hydraulic fluid over each entire piston surface opposite to said throughbore and being sized to provide force to cut 3½ inch outer diameter drill pipe.

11. The compact subsea cutting system of claim 10, further comprising a gate valve adjacent to said subsea cutting system and in fluid communication with said throughbore, providing that said gate valve comprises a seal for sealing off fluid flow through said gate valve and thereby limit fluid flow through said throughbore after said subsea cutting system cuts a tubular.

12. A subsea cutting system operable for cutting a tubular, coiled tubing and wireline, comprising:

a housing defining a throughbore;

a first gate and a second gate mounted within said housing, said first gate and said second gate being moveable transversely with respect to said throughbore between an open position and a closed position, said first and second gates being moveable in different directions with respect to each other;

a first piston and a first piston rod operably connected to said first gate, a second piston and a second piston rod operably connected to said second gate, said first piston and said second piston each comprise a piston surface with a diameter between one and one-half and two and one-half times as large as a diameter of said throughbore, said first piston rod and said second piston rod comprise a length less than two and one-quarter times as lame as a diameter of said throughbore;

said first gate and said second gate being in slidable engagement with each other in said open position and in said closed position; and said first piston and said second piston being mounted to receive hydraulic fluid over an outermost side of said first piston and said second piston with respect to said throughbore whereupon said first gate and said second gate are moveable from said open position toward said closed position for cutting said tubular in response to receiving said hydraulic fluid.

13. The subsea cutting system of claim 12, further comprising a first piston chamber for said first piston and a second piston chamber for said second piston, said first piston and said second piston being mounted so that all of each piston surface is available for engagement with hydraulic fluid when said first and second gates are moved to said closed position.

14. A subsea cutting system operable for cutting a tubular, coiled tubing and wireline, comprising:

a housing defining a throughbore;

a first gate and a second gate mounted within said housing, said first gate and said second gate being moveable transversely with respect to said throughbore between an open position and a closed position, said first and second gates being moveable in different directions with respect to each other;

a first seat mounted in said throughbore adjacent said first gate, said first gate being slidably mounted with respect to said first seat, said first seat comprising a first seat interior, said first seat interior decreasing in diameter with distance away from said first gate;

a second seat mounted in said throughbore adjacent said second gate, said second gate being slidably mounted with respect to said second seat, said second seat comprising a second seat interior, said second seat interior decreasing in diameter with distance away from said second gate;

said first gate and said second gate being in slidable engagement with each other in said open position and in said closed position; and a first piston and a second piston being mounted to receive hydraulic fluid over an outermost side of said first piston and said second piston with respect to said throughbore whereupon said first gate and said second gate are moveable from said open position toward said closed position for cutting said tubular in response to receiving said hydraulic fluid.

15. The subsea cutting system of claim 14, wherein said first gate comprises a first gate interior and said second gate comprises a second gate interior, said first gate interior decreasing in diameter with distance away from said first seat, said second gate decreasing in diameter with distance away from said second seat.

16. The subsea cutting system of claim 14, further comprising an throughbore axis through said throughbore, a first piston and a first piston rod operably connected to said first gate for movement along a first axis, a second piston and a second piston rod operably connected to said second gate for movement along a second axis, said first axis being offset from said second axis along said throughbore axis.

17. The subsea cutting system of claim 14, further comprising a first piston and a first piston rod operably connected to said first gate, a second piston and a second piston rod operably connected to said second gate, when said throughbore is oriented vertically then said first piston, said first piston rod, and said first gate is mounted to said housing at a higher vertical position than said second piston, second piston rod, and second gate.

18. The subsea cutting system of claim 14, further comprising a first piston and a first piston rod operably connected to said first gate with a first stroke length, a second piston and a second piston rod operably connected to said second gate with a second stroke length, said first and second stroke length being less than a diameter of said throughbore.

19. A subsea cutting system operable for cutting tubulars, comprising:

a housing defining a throughbore;

a first gate and a second gate mounted within said housing, said first gate and said second gate being moveable transversely with respect to said throughbore between an open position and a closed position, said first and second gates being moveable in different directions with respect to each other;

said first gate and said second gate being in slidable engagement with each other in said open position and said closed position;

a first piston and a first piston rod operably connected to said first gate;

a second piston and a second piston rod operably connected to said second gate, when said throughbore is oriented vertically then said first piston and said first piston rod is mounted to said housing at a higher vertical position than said second piston and said second piston rod; and said first piston and said second piston being mounted to simultaneously receive hydraulic fluid over an outermost side of said first piston and said second piston with respect to said throughbore whereupon said first gate and said second gate are freely moveable from said open position toward said closed position for cutting said tubulars.

20. The subsea cutting system of claim 19, wherein said first piston and said second piston each comprise a piston surface with a diameter between one and one-half and two and one-half times as large as a diameter of said throughbore.

21. The subsea cutting system of claim 20, wherein said first piston rod and said second piston rod are less than two and one-quarter times as large as a diameter of said throughbore.

* * * * *